United States Patent [19]

Lüttge et al.

[11] Patent Number: 4,728,050

[45] Date of Patent: Mar. 1, 1988

[54] WINDING APPARATUS FOR USE WITH WINDING SLEEVES OF DIFFERING DIAMETERS

[75] Inventors: Dieter Lüttge, Hameln; Helmut Spötter, Extertal; Erwin Cichon, Hameln, all of Fed. Rep. of Germany

[73] Assignee: Stahlkontor Maschinenbau GmbH, Hameln, Fed. Rep. of Germany

[21] Appl. No.: 73,869

[22] Filed: Jul. 15, 1987

Related U.S. Application Data

[63] Continuation of Ser. No. 740,657, Jun. 3, 1985, abandoned.

[30] Foreign Application Priority Data

Jul. 11, 1984 [DE] Fed. Rep. of Germany ..... 3425490

[51] Int. Cl.[4] ..... B65H 19/26

[52] U.S. Cl. ..... 242/56 A; 242/64

[58] Field of Search ..... 242/56 A, 64

[56] References Cited

U.S. PATENT DOCUMENTS

| | | | |
|---|---|---|---|
| 2,586,832 | 2/1952 | Kohler | 242/56 A |
| 3,279,716 | 10/1966 | Huck | 242/56 A |
| 3,345,009 | 10/1967 | Rockstrom | 242/56 A |
| 3,472,462 | 10/1969 | Young | 242/64 X |
| 3,630,462 | 12/1971 | Nordgren et al. | 242/64 |
| 4,058,267 | 11/1977 | Schüttler | 242/56 A |
| 4,153,215 | 5/1979 | Schulze | 242/56 A |
| 4,171,780 | 10/1979 | Bugnone | 242/56 A |

*Primary Examiner*—Stuart S. Levy
*Assistant Examiner*—Joseph J. Hail, III
*Attorney, Agent, or Firm*—Pollock, VandeSande and Priddy

[57] ABSTRACT

A winding apparatus for winding a web into rolls comprises a rotatable assembly having plural winding sleeves mounted thereon for movement between a winding position and an unloading position. The sleeves can have any one of a plurality of different diameters, and are so mounted on the assembly that when each empty sleeve reaches the winding position its periphery passes through the same predetermined point on the turning circle of the rotatable assembly regardless of the diameter of the sleeve. The apparatus also includes a web transfer unit comprising a plurality of rollers and a cutter device which is movable into an operative position adjacent an empty sleeve at the winding position when it is desired to sever the web. The rollers redirect the web so that it passes more than half way around the empty sleeve at the winding position, and the cutter then cuts the web at a position on or inside of the turning circle adjacent the predetermined point through which the sleeve periphery passes. The rollers and cutter device need not be adjusted when there is a change in the diameter of the sleeve at the winding position.

8 Claims, 5 Drawing Figures

WINDING APPARATUS FOR USE WITH WINDING SLEEVES OF DIFFERING DIAMETERS

This application is a continuation, of Ser. No. 740,657, filed on June 3, 1985 now abandoned.

BACKGROUND OF THE INVENTION

The present invention relates to an improved winding apparatus of the type comprising a rotatable assembly having a plurality of winding sleeves mounted thereon in spaced relation to one another, each of said sleeves being movable between a winding position and an unloading position in said apparatus by rotation of said assembly, the apparatus including means for feeding a web of material to a first one of said sleeves at said winding position to be wound thereon, means for rotating said assembly to move the said first sleeve to an unloading position when a desired quantity of material has been wound on said first sleeve, and cutter means for severing the web to permit the unloading of the wound first sleeve at the unloading position and to commence the winding of web material on a second one of said sleeves that has been moved to the winding position by rotation of the rotatable assembly. Apparatuses of this general type are well known in the prior art, and different forms of such apparatus are described, for example, in Schulze U.S. Pat. No. 4,153,215, Young U.S. Pat. No. 3,472,462, and Kohler U.S. Pat. No. 2,586,832.

In order to effect the continuous and rapid winding of web material onto multiple sleeves or spools in apparatuses of the general type described above, it is essential to shift an incoming supply of web material as rapidly as possible from a completely coiled roll to an empty winding sleeve, and to connect the severed end of a web of material to the empty winding sleeve with as little creasing as possible. The changeover from one roll to another should, moreover, be effected if possible without interrupting production. In the past it has been necessary to coil webs as a function of their properties on winding sleeves of a specific diameter, and to adapt all parts of the web feeding and cutting mechanisms to the corresponding, constant diameter of the winding sleeves that are employed. Known apparatuses accordingly allow for a rapid change of rolls only when material having the same properties is being wound on winding sleeves of the same diameter. It has not been possible, however, to effect continuous and rapid feeding of material when it is necessary, e.g., as a result of a change in the type of material being wound, to change the diameter of the winding sleeve employed.

More particularly, when a different diameter winding sleeve is mounted onto the apparatus, it has been considered necessary heretofore to effect adjustments of the feeding and cutting mechanisms that are associated with the winding apparatus. The objective of course is to keep the time required to attach a severed web of material to an empty winding sleeve, without creases, as short as possible. When converting to a different diameter of winding sleeve, production has had to be interrupted to effect the required adjustments, or risky and dangerous adjustments had to be implemented while the equipment remained in operation in order to properly position the blade used to sever material, the rollers or pulleys used to feed product onto the changed diameter winding sleeve, etc. These complicated adjustments have not only been time consuming and expensive, but have also required highly qualified personnel to make the necessary adjustments in optimal fashion and in a minimum of time.

The present invention obviates these problems of the prior art by the provision of a winding apparatus capable of using sleeves of differing diameters without requiring adjustments of the type considered necessary heretofore, and without interrupting the product feed.

SUMMARY OF THE INVENTION

The winding apparatus of the present invention provides the rotatable assembly upon which the winding sleeves are mounted with mounting means adapted to mount sleeves of any one of a plurality of different diameters thereon. The said mounting means includes means for selecting the position of the axis of rotation of each sleeve on the turning circle of the rotary apparatus as a function of the diameter of the sleeve, to so position each said sleeve on the turning circle that the peripheries of the sleeves of all of said different diameters pass through the same predetermined point on said turning circle when each said sleeve is moved to the winding position. This control of the position of each sleeve, as a function of its diameter, can be effected manually by a machinist, using different guide marks, or it can be effected by a controller or processor which selects the position of the axis of rotation of a given sleeve as a function of its diameter, by use of a sensing device such as a photocell which is responsive to the diameter of a given sleeve. The position of the axis of rotation of a given sleeve need only be shifted by half the difference of the diameter between the smallest sleeve and the sleeve whose diameter is different.

By controlling the position of the axis of rotation of each sleeve as a function of its diameter, the cutting plane between the turning circle of the rotatable assembly and the peripheral surface of an empty sleeve located at the winding position is always the same regardless of the diameter of the sleeve that is located at the winding position. The said cutting plane is directly in the area of the turning circle, closely adjacent the intersection of the said turning circle and the peripheral surface of an empty sleeve at the winding position. Therefore it is possible to keep the position of the cutting mechanism unchanged even though there has been a change in the diameter of the sleeve at the winding position. In addition, it is no longer necessary to make any adjustments in the web feeding mechanism when a sleeve of different diameter is mounted on the rotatable assembly. As a result, the time consuming adjustments that were necessary heretofore are no longer required, and the overall apparatus is simplified because the various adjustment units, previously required to adapt the winding apparatus to winding sleeves of different diameter, are no longer necessary. Moreover, there is no longer a need for the skilled personnel, or the risk of accidents, which characterized the adjustment procedures considered necessary heretofore.

BRIEF DESCRIPTION OF THE DRAWINGS

The foregoing objects, advantages, construction and operation of the present invention will become more readily apparent from the following description and accompanying drawings wherein.

DESCRIPTION OF THE PREFERRED EMBODIMENTS

Figure 1:
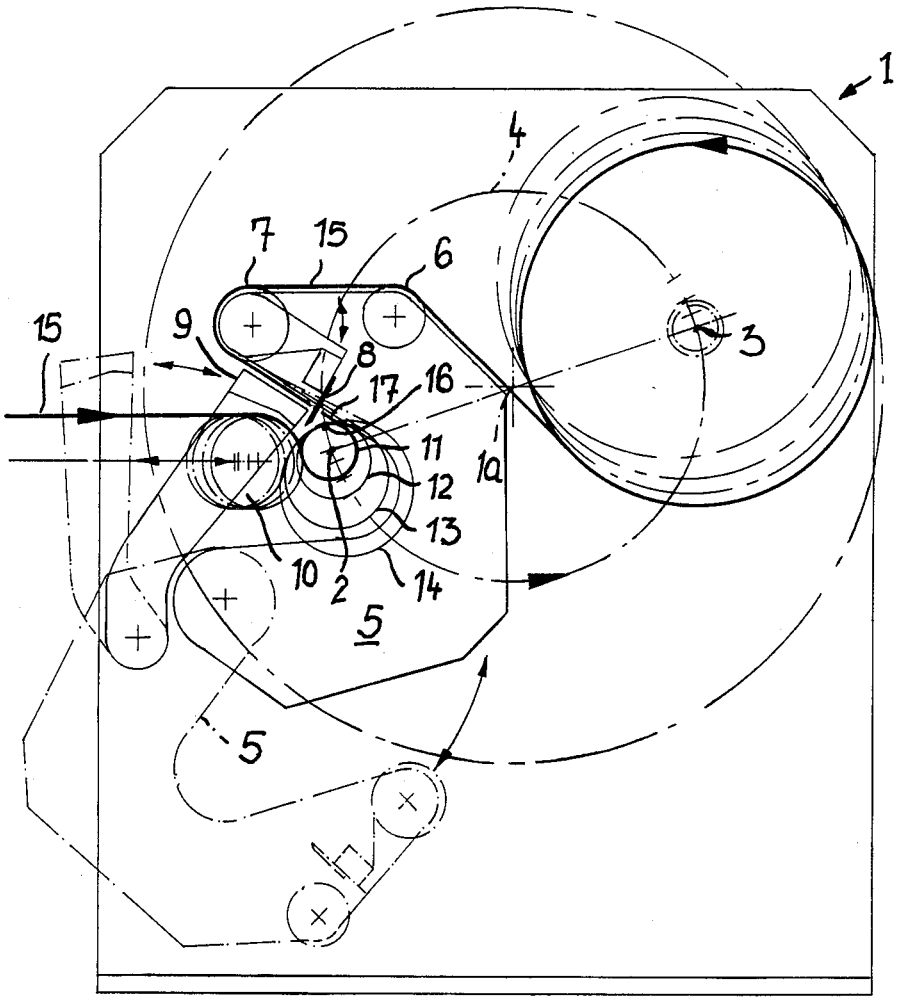
FIG. 1 diagrammatically represents a winding apparatus constructed in accordance with one embodiment of the present invention, showing the parts thereof in the position they assume when a web is to be severed.

The multiple winding device of the present invention is designated by numeral 1. It comprises a rotatable assembly mounted for rotation about a central axis 1*a* and having means thereon for supporting at least two winding sleeves between a winding position 2 and an unloading position 3. The mounting means employed may comprise, for example, cones at both sides of a cylindrical hollow empty sleeve. The winding sleeves may take the form of spools, cores, reels or the like and, in accordance with the present invention, each such winding sleeve may have any one of a plurality of different diameters, the different diameter sleeves being designated, by way of example, as sleeves 11, 12, 13 and 14. Each such sleeve can be either nonaxial, or have winding shafts, and each such sleeve has its axis of rotation located on a common turning circle 4 which is concentric with central axis 1*a*.

The device further includes a web transfer unit 5 and an associated anvil unit 9 each of which is normally in the position shown in broken line in FIG. 1, but each of which is movable into the position shown in full line in FIG. 1 when web material 15 is to be severed. The web transfer unit 5 includes a pair of rollers 6 and 7 which are positioned respectively inside and outside of the winding circle 4 when the web transfer unit 5 is moved into its full line position, and web transfer unit 5 further includes cutter means consisting of a cross-cutting blade 8 which, in the embodiment of FIG. 1, is mounted for pivotal motion about the axis of rotation of roller 7. As shown in FIG. 1, when web transfer unit 5 and anvil unit 9 are in their full line positions, cutting blade 8 and anvil unit 9 are located respectively on opposite sides of the portion 17 of web 15, the blade 8 then being movable toward web 9 to sever web portion 17 at a position that is located on or inside of turning circle 4.

The winding apparatus further includes a pressure roller 10 which is guided in a horizontal guideway of a special machine frame (not shown), and which is caused to press against the winding sleeve or spool at winding position 2 by means of a servomotor or servocylinder (not shown). The pressure exerted by roller 10 is preferably adjustable, and the position of the roller is adapted to shift (to the left, as shown in FIG. 1) between the location represented in full line and the successive broken line representations when there is an increase in the diameter of an empty sleeve that is moved into winding position 2, and as the roll of web material being wound at winding location 2 increases in diameter.

The overall operation of the winding apparatus is as follows. Assume initially that an empty winding sleeve is located at both winding position 2 and unloading position 3, and that web transfer unit 5 and anvil unit 9 are each in their broken line position. An incoming web 15 of material to be wound, provided from a supply of such material, passes through the nip between pressure roller 10 and the winding sleeve at winding position 2, e.g., sleeve 11, and is wound thereon. As the roll of material on the sleeve at position 2 increases in diameter, pressure roller 10 moves away from the axis of rotation of said sleeve. When the diameter of the roll being wound on sleeve 11 reaches a desired diameter, e.g., as determined by an appropriate sensor (not shown) associated with the roll being wound or with pressure roller 10, a motor (not shown) is energized to index the rotatable assembly of the apparatus to move the wound roll along turning circle 4 from winding position 2 to unloading position 3 and, thereby, to simultaneously move a new unwound sleeve from its prior position 3 to winding position 2.

Immediately after or concurrently with the aforementioned indexing operation, web transfer unit 5 and anvil unit 9 are moved by appropriate motors or hydraulic cylinders from the broken line positions to the full line positions shown in FIG. 1. As web transfer unit 5 moves into its full line position, it engages the length of web material which extends from the empty sleeve at position 2 to the wound roll at position 3, and redirects that length of web into the configuration shown in FIG. 1, i.e., the web emerging from the nip between pressure roller 10 and empty sleeve 11 is wrapped more than half way around empty sleeve 11, is then directed to pass from a location inside turning circle 4 across said turning circle to the roller 7 located outside of turning circle 4, then passes back across turning circle 4 to roller 6 which is inside the circle 4, and then passes substantially across the central axis 1*a* of the rotatable assembly to the wound roll at unloading position 3. With the various elements in the relative positions shown in FIG. 1, the cutter device is then actuated to cause the portion 17 of web 15 leaving sleeve 11 to be severed by movement of blade 8 toward anvil 9, this operation simultaneously directing the short tail portion 17 of the web onto the empty spool, e.g., 11, at winding position 2, and the length of web 15 downstream of said cutting position continues over rollers 7 and 6 onto the wound sleeve or spool at unloading position 3. Web transfer unit 5 and anvil 9 are then returned to the broken line positions shown in FIG. 1, and the wound spool at unloading position 3 is removed from the rotatable assembly and replaced by a new empty spool or sleeve preparatory to a further operating sequence similar to that described.

In order to keep the length 17 of the severed web as short as possible at high feed speeds and for the various possible diameters of the winding sleeves 11, 12, 13 or 14, crease-free attachment to the empty sleeve at winding position 2, it is important that the cross-cutting blade 8 cut the web at a point which is on or within turning circle 4. Moreover, to avoid the need to effect adjustments when the diameter of the winding sleeves employed is changed, it is important that the positions of elements 6, 7, 8 and 9 be fixed without regard to the diameter of the winding sleeve that has been moved from position 3 to position 2 during the aforementioned operating sequence. This is accomplished by providing the rotatable assembly with mounting means for the winding sleeves which not only position the axis of rotation of each said sleeve on the turning circle 4, but which also select and/or shift the position of said axis of rotation as a function of the sleeve diameter so that the periphery of each unwound sleeve that is moved into the winding position 2, passes through the same point 16 on turning circle 4, closely adjacent to the cutting plane defined by blade 8, for all winding sleeves of the possible different diameters designated 11, 12, 13 and 14.

This adjustment in position of the axis of rotation of an empty winding sleeve along the turning circle 4 is effected at the time the unwound sleeve or spool is mounted on the rotatable assembly in place of the full roll that has been removed from unloading position 3, and is controlled by a machinist by hand using different guide marks, or by an automatic adjustment mechanism which utilizes a limit switch, photocell or process computer that functions to select or shift the location of the axis of rotation of a sleeve being mounted on the rotatable assembly as a function of the diameter of said sleeve.

Figure 2:
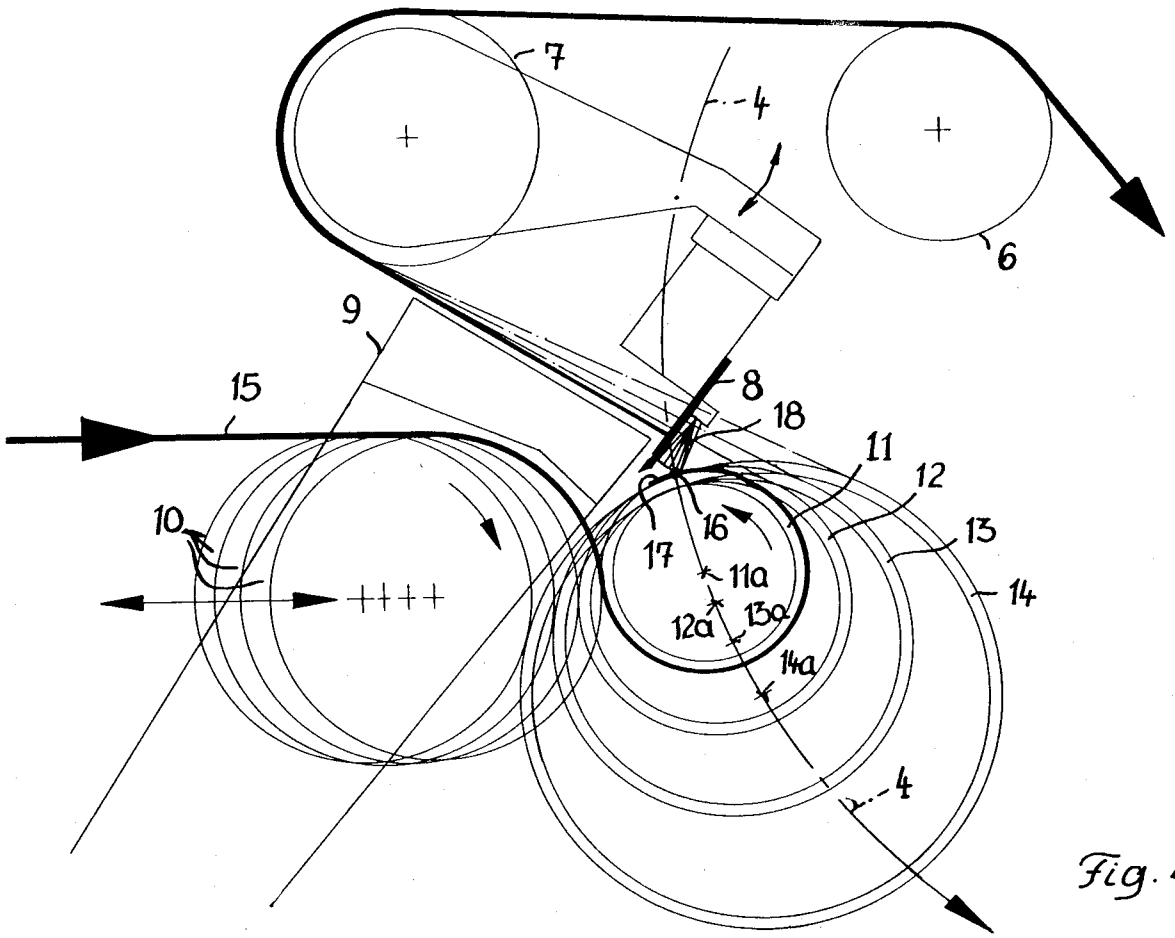
FIG. 2 is an enlarged representation of the cutting area of the apparatus shown in FIG. 1, illustrating the relative positions of sleeves of different diameters.

The result of the aforementioned selection, shifting or adjustment procedure is shown in FIG. 2 wherein the numerals 11*a*, 12*a*, 13*a* and 14*a* represent respectively the positions of the axes of rotation of four different diameter sleeves 11, 12, 13 and 14 along turning circle 4. As is apparent from FIG. 2, the location of each such axis of rotation is shifted by half the difference between the actual diameter of the sleeve being mounted on the apparatus and the diameter of the smallest diameter winding sleeve 11 that can be mounted on the apparatus. FIG. 2 also illustrates the successive different positions which pressure roller 10 may take at the beginning of a winding operation, in dependence upon the diameter of the empty sleeve that has been moved into the winding position.

The broken line representations of the portion of the web leaving each of the possible different diameter sleeves 11, 12, 13 and 14, in relation to the fixed plane through which cutting knife 8 passes, further illustrates that the location at which the web is severed is either on turning circle 4 (for the smallest diameter sleeve 11) or inside of said turning circle 4 (for the successively larger diameter sleeves 12, 13 and 14). FIG. 2 further illustrates that the web transfer unit can be provided with a brush 18 or an air jet to assist in attaching the short severed length 17 of web 15 to the empty winding spool at the winding location. Because the web portion 17 upstream of cutting blade 8 is short in length, it is fed crease-free and without folds onto the empty winding sleeve at winding position 2.

Figure 3:
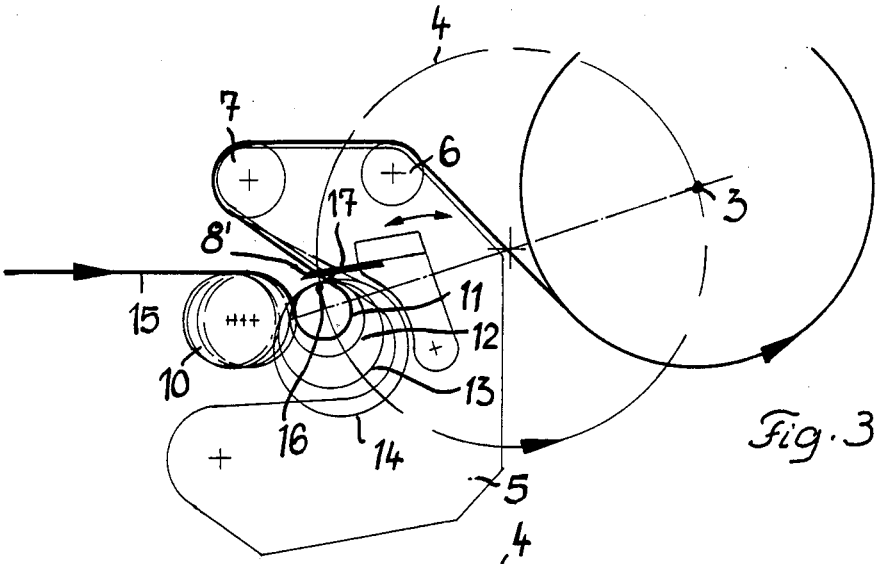
FIG. 3 is a representation similar to FIG. 1 depicting a second embodiment of the invention.

The embodiment of the invention shown in FIG. 3 is similar to that described by reference to FIGS. 1 and 2, except that the cutting blade 8' on the web transfer unit 5 is not mounted for pivotal motion about the axis of roller 7 and, instead, is mounted for pivotal motion about a different axis that is spaced from each of rollers 6 and 7. As a result, the cutting plane through which blade 8' moves differs from that shown in FIGS. 1 and 2, but the actual cutting location remains essentially the same, i.e., it is still either on turning circle 4 or within said turning circle at a point along web 15 which is closely adjacent to and immediately downstream of the common point 16 through which the periphery of every possible diameter winding sleeve 11–14 passes.

Figure 4:
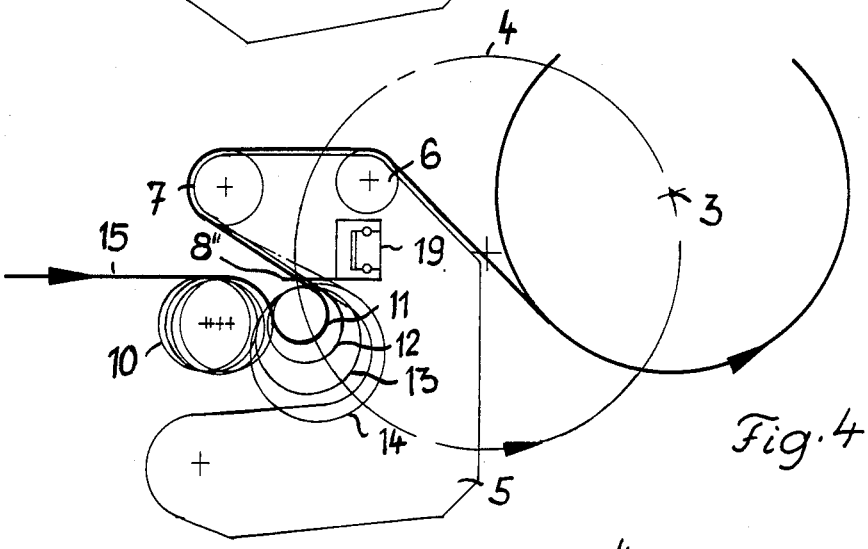
FIG. 4 is a representation similar to FIG. 1 depicting a third embodiment of the invention.

FIG. 4 represents another embodiment similar to those described above which, however, uses a cross cutting blade 8'' which is designed as a sickle or hook-like blade, the blade being guided for generally linear motion by a guide track 19. Again, however, the point at which the web is cut is on or within the turning circle 4 immediately downstream of the common peripheral point of all of the possible different diameter sleeves 11–14.

Figure 5:
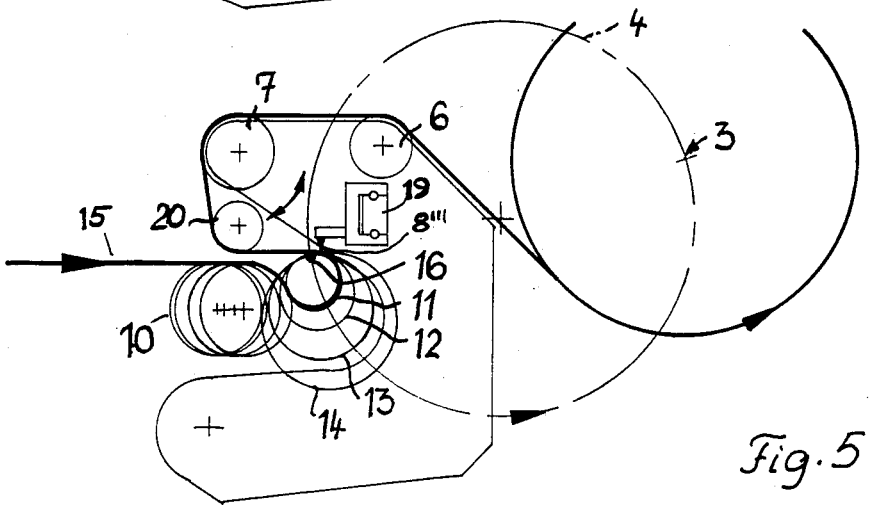
FIG. 5 is a representation similar to FIG. 1 depicting a fourth embodiment of the invention.

In the embodiment of FIG. 5, the web transfer unit is provided with an additional roller 20 that causes the web leaving the empty roller at the winding position to be substantially tangent to the common point 16 through which the peripheries of all the possible different diameter sleeves 11–14 pass. The cutting blade 8''' used in this embodiment is again guided for motion by a guide track 19, but the motion is in a direction that is substantially at right angles to the motion of blade 8'' (FIG. 4). As a result, instead of the blade passing through the web 15 at an oblique angle, as in FIG. 4, the blade 8''' in the embodiment of FIG. 5 moves in a direction that is substantially perpendicular to the product feed. As in the other embodiments, however, the point at which the web is severed in the embodiment of FIG. 5 is on or inside of turning circle 4.

Having thus described our invention, we claim:

1. A winding apparatus comprising a rotatable assembly having a plurality of winding sleeves mounted thereon in spaced relation to one another, each of said sleeves being moved between a predetermined winding position and a predetermined unloading position by rotation of said assembly through a turning circle, the axes of rotation of each of said sleeves being on said turning circle, said apparatus including means for feeding a web of material to an unwound first one of said sleeves at said winding position to be wound thereon, means for rotating said assembly to move said first sleeve and the web material wound thereon from said winding position to said unloading position when a desired quantity of said material has been wound on said first sleeve and for simultaneously moving an unwound second one of said sleeves into said winding position, said rotatable assembly including mounting means for mounting unwound sleeves of a plurality of different diameters on said turning circle, the axes of rotation of different diameter ones of said unwound sleeves being noncoincident with one another, said mounting means including means for selecting a unique position for the axis of rotation of each unwound sleeve on said turning circle as a function of the diameter of said unwound sleeve to so position each said sleeve on said turning circle that the periphery of each unwound sleeve of each of said different diameters passes through the same predetermined point on said turning circle when said unwound sleeve is at said winding position, said sleeve being retained at said unique position while said material is being wound thereon and until it is moved to said unloading position by said menas for rotating said assembly, a web transfer unit mounted at a fixed location adjacent said turning circle and operative to direct said web of material from a wound sleeve at said unloading position to an unwound sleeve at said winding position across said turning circle at a crossing point on said turning circle that is closely adjacent to the said predetermined point through which the peripheries of all of said different diameter unwound sleeves pass, and a cutter mechanism mounted at a fixed location relative to said turning circle adjacent to said winding position, the respective locations of said web transfer unit and cutter mechanism relative to said turning circle being the same regardless of changes in the diameter of the unwound sleeve at said winding position, said cutter mechanism being operative to sever said web at substantially the same location closely adjacent to said web crossing point on said turning circle regardless of the diameter of the unwound sleeve that is at said winding position.

2. The apparatus of claim 1 wherein the location at which said cutter mechanism severs said web is on said turning circle.

3. The apparatus of claim 1 wherein the location at which said cutter mechanism severs said web is between said predetermined point and said web crossing point inside of said turning circle.

4. The apparatus of claim 1 wherein said cutter mechanism includes a knife which severs said web along a plane that is substantially perpendicular to the plane of the web passing from the wound sleeve at said unloading position to the unwound sleeve at said winding position.

5. The apparatus of claim 4 wherein said cutter mechanism includes an anvil unit which is movable to a position adjacent the side of said web opposite to the web side which faces said knife, the position to which said anvil unit moves being the same regardless of the diameter of the sleeve that is at said winding position.

6. A winding apparatus comprising a rotatable assembly having at least two winding sleeves located in spaced relation to one another and individually rotatable about respective axes that are located on a turning circle which is concentric with the axis of rotation of said rotatable assembly, means for mounting unwound sleeves of a plurality of different diameters on said rotatable assembly, the axes of rotation of different diameter ones of said sleeves being noncoincident with one another and being spaced from one another along said turning circle by distances that are a function of the different diameters of said sleeves, means for feeding web material to one of said unwound sleeves at a winding position on said turning circle to be wound thereon, and means for retaining an unwound one of said sleeves at a fixed location at said winding position while material is being wound thereon and for thereafter moving said wound sleeve from said winding position to an unloading position on said turning circle while simultaneously moving another unwound sleeve into said winding position and for then severing said web material at a location between said wound sleeve and said other unwound sleeve to permit the winding of a new length of said material on the said other of said unwound sleeves, said feeding means comprising web transfer means operable when said web material is to be severed for feeding web material from the wound one of said sleeves at said unloading position to a location outside of said circle and thence across said turning circle at a crossing location to the inside of the turning circle to the unwound one of said sleeves at said winding position, and means for adjusting the position of the axis of rotation of the unwound one of said sleeves at said winding position along said turning circle as a function of the diameter of said unwound one of said sleeves to cause a peripheral portion of said unwound sleeve to intersect said turning circle at a predetermined fixed point on said turning circle which remains the same regardless of any change in the diameter of the unwound sleeve that has been moved into said winding position, said predetermined fixed point being located closely adjacent to said web crossing location on said turning circle, said severing means being mounted at a fixed location closely adjacent said turning circle which fixed location is not changed when the diameter of the sleeve at said winding location is changed, the location of said severing means being preselected to cause said severing means to always sever said web material closely adjacent to the said fixed point through which the said peripheral portions of all of said different diameter unwound sleeves pass.

7. The apparatus of claim 6 wherein said web transfer means comprises a plurality of rollers movable as a unit into an operative position wherein said rollers are in engagement with said web material when said web material is to be severed, one of said rollers being located outside of said turning circle and another of said rollers being located inside said turning circle when said web transfer means is in said operative position, said severing means being attached to said web transfer means for movement with said unit.

8. The apparatus of claim 7 wherein said severing means is mounted for pivotal motion about the axis of rotation of one of said rollers.

* * * * *